US007132604B2

(12) United States Patent
Scheidecker et al.

(10) Patent No.: US 7,132,604 B2
(45) Date of Patent: Nov. 7, 2006

(54) CABLE WITH AN EXTERNAL EXTRUDED SHEATH AND METHOD OF MANUFACTURING OF THE CABLE

(75) Inventors: Ralf Scheidecker, Geisa (DE); Horst Reinhard, Hauneck (DE); Peter Schwirblies, Bad Hersfeld (DE); Hal Armstrong, Fergus (CA); Hal Aitken, Rockwood (CA)

(73) Assignee: Nexans, Paris (FR)

( * ) Notice: Subject to any disclaimer, the term of this patent is extended or adjusted under 35 U.S.C. 154(b) by 439 days.

(21) Appl. No.: 10/273,845

(22) Filed: Oct. 21, 2002

(65) Prior Publication Data

US 2003/0079903 A1 May 1, 2003

(30) Foreign Application Priority Data

Oct. 22, 2001 (EP) ..... 01402742.9

(51) Int. Cl.
*H01B 7/00* (2006.01)

(52) U.S. Cl. ..... 174/110 R; 174/110 V

(58) Field of Classification Search ..... 174/36, 174/110 R, 110 SR, 110 V, 110 FC, 113 R, 174/116, 120 R, 120 C, 120 AR, 120 SR
See application file for complete search history.

(56) References Cited

U.S. PATENT DOCUMENTS 3,943,087 A * 3/1976 Leuchs ..... 524/141
3,972,970 A * 8/1976 Taylor ..... 264/45.9
4,008,368 A * 2/1977 Leuchs ..... 174/120 R
4,058,669 A * 11/1977 Nutt et al. ..... 174/34
4,174,236 A * 11/1979 Dougherty et al. ..... 156/51
4,262,464 A * 4/1981 Ludowici ..... 52/510
4,383,166 A * 5/1983 Chu et al. ..... 377/20
4,425,474 A * 1/1984 Durr et al. ..... 174/110 F
4,443,657 A * 4/1984 Hill et al. ..... 174/110 FC
4,512,944 A * 4/1985 Astfalk et al. ..... 264/171.17
4,881,995 A * 11/1989 Arenz ..... 156/52
4,997,689 A * 3/1991 Langen et al. ..... 428/34.9
5,089,329 A * 2/1992 de Vrieze et al. ..... 428/313.5
5,120,377 A * 6/1992 Morohashi et al. ..... 156/89.17
5,162,609 A * 11/1992 Adriaenssens et al. ..... 174/34
5,210,377 A 5/1993 Kennedy et al.
5,462,803 A * 10/1995 Wessels ..... 428/380
5,554,236 A * 9/1996 Singles et al. ..... 156/52
5,841,072 A * 11/1998 Gagnon ..... 174/110 F
5,841,073 A * 11/1998 Randa et al. ..... 147/113 R
6,185,155 B1 * 2/2001 Steinich ..... 367/140
6,392,152 B1 * 5/2002 Mottine et al. ..... 174/110 PM
6,469,251 B1 * 10/2002 Dupuis ..... 174/113 R (Continued)

FOREIGN PATENT DOCUMENTS

DE 2521526 A1 11/1975

(Continued)

OTHER PUBLICATIONS

Database WPI. Week 1, Jul. 20, 1997. Derwent Publication Ltd. AN 1997-171053 XP002186796 corresponding to JP 09035544 A (Yazaki Corp.) dated Feb. 7, 1997.

*Primary Examiner*—William H. Mayo, III
(74) *Attorney, Agent, or Firm*—Sughrue Mion, PLLC

(57) ABSTRACT

A cable has a core, which is surrounded by an external extruded sheath. The core of the cable has at least one transmission element for the transmission of electrical current or telecommunication signals. The sheath comprises at least one flexible layer of a conventional, expanded material, this material having a tensile strength between 10.0 MPa and 50.0 MPa.

23 Claims, 1 Drawing Sheet

U.S. PATENT DOCUMENTS 6,501,027 B1 * 12/2002 Belli et al. ..... 174/110 F

FOREIGN PATENT DOCUMENTS

| | | | | |
|---|---|---|---|---|
| DE | 3515574 | A1 | | 11/1985 |
| DE | 271977 | A1 | | 9/1989 |
| DE | 43 329 914 | A | * | 3/1995 |
| GB | 1344686 | | | 1/1974 |
| JP | 07-330937 | A | * | 12/1995 |
| JP | 09-035544 | A | * | 2/1997 |
| WO | WO 98/52197 | | * | 11/1998 |

* cited by examiner

CABLE WITH AN EXTERNAL EXTRUDED SHEATH AND METHOD OF MANUFACTURING OF THE CABLE

The invention is concerned with a cable the core of which is surrounded by an external extruded sheath, which core comprises at least one transmission element for the transmission of electrical current or telecommunication signals. The invention also is concerned with a method of manufacturing of such a cable.

BACKGROUND OF THE INVENTION

The word "cable" also stands for the word "line". "Cable" can be an electrical or optical cable with any design of the core which is surrounded by a sheath of insulating material. "Transmission elements" can be metallic electrical conductors or optical waveguides. Such cables have a protective outer sheath of insulating material with different characteristics depending on the type of the cable and the field of use of the same. The thickness of the sheath is variable depending on the mentioned characteristics. The amount of material for forming the sheath of such cables normally is high. The portion of the sheath to the weight of the complete cable is considerable.

WO 98/52197 describes a power transmission cable with an outer coating made of expanded polymer material. The coating shall be capable of protecting the cable from accidental impacts. A separate metal armor shall not be needed. The coating therefore has special mechanical characteristics to absorb impacts. The used material has a degree of expansion from 20% to 3000% and a flexural modulus between 400 MPa and 1800 MPa. Such a material is expensive. Its weight is lower compared to the not expanded version. But for the purpose of impact protection the coating of expanded polymer material needs an adequate thickness and flexural modulus together with a great mass. Therefrom the weight of the sheath still is high. Such a coating therefore only is useful with cables which normally have a metal armor and then can be manufactured without such an armor.

WO 98/52197 also mentions documents which describe cables for the transmission of signals with a layer of expanded insulating material. Such a material shall be useful only for the increase of the transmission speed of the signals. A hint for impact protection shall not to be found in these documents.

From GB specification 1 339 561, an electrical cable is known, preferably a telecommunication cable, which also shall be protected against mechanical stresses, like impacts, without a special armoring. The core of the cable is surrounded by a layer of expanded insulating material which is surrounded by a layer of not expanded insulating material. The expanded layer has a greater thickness then the not expanded layer. This known cable is comparable with the cable of WO 98/52197.

SUMMARY OF THE INVENTION

It is an object of the invention to provide a cable, and a corresponding method of production with a reduced weight and a reduced amount of extruded material for the outer sheath with normally used materials while its core design is maintained.

According to the invention the sheath comprises at least one flexible layer of a conventional, expanded material, this material having a tensile strength between 10.0 MPa and 50.0 MPa.

Such a cable has a lower weight than a cable with the same core, because the sheath with the same thickness is lighter depending on the enclosed gas bubbles. For the same reason, the amount of sheathing material is reduced and the complete cable is more cost effective. Because of the reduced amount of sheathing material the incendiary load is reduced, as well as a danger for the environment. In case of fire, the amount of smoke and the heat release also are reduced. A special advantage of this cable is the fact that for its manufacturing conventional materials can be used without special treatment. It is not necessary to consider a high transmission speed for signals and an increased impact resistance also is not needed. The sheath of the cable only must guarantee the protection of the enclosed core also then when the cable is drawn under increased forces.

The cable can be manufactured in conventional technique with unchanged designs of the core. The sheath also can be applied in conventional technique by extrusion. A chemical blowing agent can be added to the material before extrusion. It also is possible to use the method of gas injection for expanding the sheathing material without chemical additives.

The cable of the invention in a prefered embodiment is a house wiring cable, which is installed in buildings for illumination purposes and for power supply of electrical devices. Such cables are used in great volumes all over the world. The advantages of the invention are extremly interesting with such cables. That is true not only for weight and amount of sheathing material but especially for the low incendiary load and the reduced formation of smoke and release of heat.

BRIEF DESCRIPTION OF THE DRAWINGS

Examples of and prefered embodiments of the invention are shown in the drawings, wherein.

DETAILED DESCRIPTION OF THE INVENTION

Figure 1:
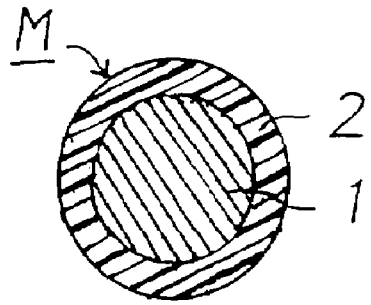
FIG. 1 is a schematic crossection of the cable of the invention with any design of the core.

The cable of FIG. 1 can be e.g. a power cable, a medium voltage cable or a telecommunication cable with electrical or optical conductors. The design of the core 1 depends on the type of cable. The core 1 is shown with crosshatching and not more detailed because a special design here is not of interest. It is surrounded by a sheath M comprising one layer of an expanded sheathing material. The thickness of the sheath M is variable. It depends on the type of cable. It can e.g. ly between 1.4 mm and 2.2 mm.

Any material can be used for the sheath M. But it is necessary that the material of the sheath M can not hinder the flexibility of the cable and the tensile strength of the same must be between 10.0 MPa and 50.0 MPa, to guarantee the demanded function of protection. In a prefered embodiment a Polyvinylchloride comprising a plasticizer is used for the sheath M, that means a relatively soft and flexible Polyvinylchloride. It also is possible to use e.g. Polyethylene, Polypropylene or Polyurethane as sheathing material.

Figure 2:
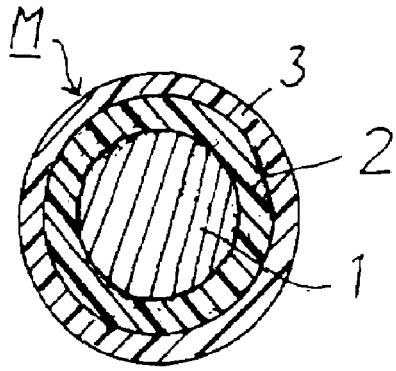
FIG. 2 is a crossection of the cable of FIG. 1 with an additional feature.

According to FIG. 2 the sheath M additionally can comprise a layer 3 of not expanded sheathing material which surrounds the layer 2 of expanded sheathing material. Both layers 2 and 3 can consist of the same compound recipe or of the same basic material, but having different compound recipes. It also is possible to use different materials, wherein e.g. the same basic material can be used with different qualities. The thicknesses of the two layers 2 and 3 e.g. can be as 60:40.

For a sheath M comprising two layers 2 and 3 as basis material e.g. Polyvinylchloride (PVC) is used, e.g. as follows:

| | |
|---|---|
| Layer 2 | |
| 37.4 | parts PVC with K-value 70 |
| 20.5 | parts plasticizer |
| 41.1 | parts chalk |
| 1 | part stabilizer. |
| Layer 3 | |
| 49.4 | parts PVC with K-value 70 |
| 24.6 | parts plasticizer |
| 24.6 | parts chalk |
| 1.2 | parts stabilizer |
| 0.2 | parts color. |

For the production of a cable according to FIG. 1 or 2, after completion of the core 1, at least the layer 2 is applied to the same in an extruder with a chamber through which the core 1 is drawn. The used sheathing material can comprise a chemical additive for expansion of the material which forms the layer 2. To guarantee a homogeneous expansion of the sheathing material, the agent for expansion can be added to the compound in a constant dosing flow. That can be achieved by using a corresponding dosing screw for dosing the agent into the sheathing material at the input of the extruder. The agent alternatively already can be added to the compound before filling the same into the extruder. The expansion of the sheathing material of layer 2 can be achieved also by gas injection without a chemical additive. Gas then is blown into the molten sheathing material within the extruder. The expansion rate of the sheathing material can be from 5% to 50%. 10% to 20% is prefered.

Figure 5:
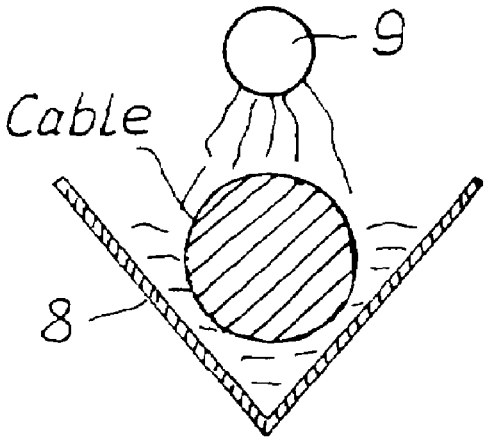
FIG. 5 is a schematic view of a cooling trough.

Of influence to a constant rate of expansion of the sheathing material is the handling of the cable behind the extruder. The cable then is guided through a cooling system with a special volume of cooling water, depending on the dimensions of the respective cable. By using pressure reducing valves it is possible to keep the water volume at a constant value. The volume of the water can easily be controlled by use of a V-shaped cooling trough 8 according to FIG. 5. With such a trough 8 it also is possible to minimize the volume of cooling water, which is fed by or through a pipe 9, for higher speeds of the cable that is drawn through the trough without the danger of damaging the expanded sheathing material. After cooling the cable can be wound on a drum.

The layer 3 of the sheath M which is made of not expanded material can be applied in the same production step as the layer 2. That can be done by coextrusion in a common extrusion die. It is also possible to use a second extruder behind the first one and to apply the two layers 2 and 3 in tandem technique.

Figure 3:
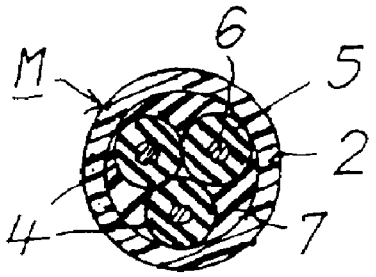
FIGS. 3 and 4 are crossections of two different house wiring cables.
Figure 4:
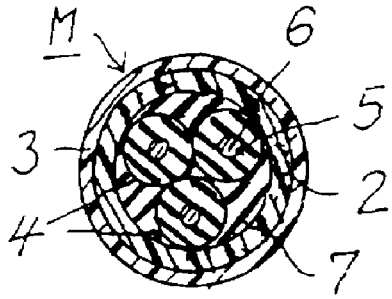

A sheath M in one layer 2 of FIG. 1 or two layers 2 and 3 of FIG. 2 is used with special advantages with house wiring cables as shown in FIGS. 3 and 4. Such cables are used with electrical voltages up to 1 kV. Normally they have two to five insulated wires which are stranded together and surrounded by a common sheath. House wiring cables also can comprise more than five insulated wires.

The cable of FIGS. 3 and 4 has three insulated wires 4, each with an insulation 5 surrounding a metallic conductor 6. The wires 4 normally are stranded with each other. The conductors 6 are made of copper. The insulation 5 can consist of Polyvinylchloride containing a plasticizer in the same manner as the sheath M. But again e.g. Polyethylene, Polypropylene or Polyurethane can be used. A filler 7 is applied for filling at least the interstices between the wires 4. The material of filler 7 e.g. can be a material on the basis of Polyvinylchloride, Rubber, EPDM (Ethylen Propylen Terpolymer) or POE (Poly Olefin Elastomer). The filler 7 consists e.g. for easy removal of a Polyolefin highly filled with chalk. It can extend over the wires 4. With its circular surface the filler 7 is a support for the sheath M which can be applied according to the method of FIG. 1 or FIG. 2.

For an additional reduction of weight and costs of the cable also the insulation of the wires within the core 1 of the cable in general and the filler 7 of the cable of FIGS. 3 and 4 can be made of expanded material. The expansion rate of the filler 7 can be from 10% to 80%. Again such an embodiment has special advantages with house wiring cables.

Instead of the electrical transmission elements of the described embodiments of the invention at least one optical waveguide can be comprised within the core 1 of the cable. The sheath of such an optical cable can be the same as described above for the sheath M.

According to the description above the sheath M comprises either one layer 2 or two layers 2 and 3. It also can comprise more than two layers. That is true also for the layer 2 of expanded insulating material alone, wherein different layers of the same e.g. can have different degrees of expansion.

The invention claimed is:

1. A cable having a core, which is surrounded by an external extruded sheath, the core comprising at least one transmission element for the transmission of electrical current or telecommunication signals, wherein the sheath (M) comprises at least one flexible layer (2) of an expanded material, wherein the expanded material is a conventional Polyvinylchloride comprising a plasticizer, the Polyvinylchloride has a tensile strength between 10.0 MPa and 50.0 MPa; and the degree of expansion of the Polyvinylchloride is from 5% to 20%.

2. A cable according to claim 1, characterized in that the Polyvinylchloride is expanded by chemical additives.

3. A cable according to claim 1, characterized in that the Polyvinylchloride is expanded by gas injection.

4. A cable according to claim 1, characterized in that the layer (2) of expanded material is surrounded by a layer (3) of not expanded material.

5. A cable according to claim 4, characterized in that the two layers (2,3) of the sheath (M) consist of the same composition.

6. A cable according to claim 4, characterized in that the two layers (2,3) of the sheath (M) consist of the same basic material, but have different compositions.

7. A cable according to claim 4, characterized in that the two layers (2,3) of the sheath (M) are made of different basic materials.

8. A cable according to claims 4, characterized in that the layer (3) of not expanded sheathing material comprises about 49.4 parts Polyvinylchloride with K-value 70, about 24.6 parts plasticizer, about 24.6 parts chalk, about 1.2 parts stabilizer and about 0.2 parts color.

9. A cable according to claims 1, characterized in that the layer (2) of expanded Polyvinylchloride comprises about 37.4 parts Polyvinylchloride with K-value 70, about 20.5 parts plasticizer, about 41.1 parts chalk and about 1 part stabilizer.

10. A cable according to claim 1, characterized in that the core (1) comprises at least two insulated wires (4) which together are surrounded by the sheath (M) of expanded sheathing material.

11. A cable according to claim 10, characterized in that the insulation of the wires (4) is expanded.

12. A cable according to claim 1, characterized in that the core (1) comprises at least one optical waveguide.

13. Use of a cable according to claim 1 with house wiring cables for electrical voltages up to 1 kV.

14. A method for the production of a cable with a core which is surrounded by an external extruded sheath (M), wherein within the core at least one transmission element for the transmission of electrical current or telecommunication signals is arranged, and wherein the sheath (M) is extruded in at least one production step forming at least one flexible layer (2) of an expanded material, wherein the expanded material is a conventional Polyvinylchloride, which comprises a plasticizer and has a tensile strength between 10.0 MPa and 50.0 MPa; and the Polyvinylchloride is expanded with a degree of expansion of 5% to 20%.

15. A method according to claim 14, characterized in that the Polyvinylchloride is expanded by chemical additives.

16. A method according to claim 15, characterized in that the chemical additives are dosed by a dosing screw into the Polyvinylchloride at the input of the extruder.

17. A method according to claim 15, characterized in that the chemical additives are given to a compound which is used as a material of the sheath before filling the same into the extruder.

18. A method according to claim 14, characterized in that the expansion of the Polyvinylchloride is achieved by gas injection.

19. A method according to claim 14, characterized in that the cable behind the extruder is cooled in a cooling system with a controlled volume of water.

20. A method according to claim 19, characterized in that the cable is guided through a V-shaped cooling trough (8).

21. A method according to claim 14, characterized in that a layer (3) of not expanded material is formed around the layer (2) of expanded Polyvinylchloride.

22. A method according to claim 21, characterized in that the two layers (2,3) of the sheath (M) are applied in coextrusion technique.

23. A method according to claim 21, characterized in that the two layers (2,3) of the sheath (M) are applied in tandem technique.

* * * * *